United States Patent [19]

Kuno

[11] Patent Number: 4,848,135

[45] Date of Patent: Jul. 18, 1989

[54] PROCESS FOR MAKING A COIL

[75] Inventor: Kazuo Kuno, Kobe, Japan

[73] Assignee: Mitsubishi Denki Kabushiki Kaisha, Japan

[21] Appl. No.: 48,871

[22] Filed: May 12, 1987

[30] Foreign Application Priority Data

May 13, 1986 [JP] Japan ..... 61-107581

[51] Int. Cl.[4] ..... B21C 47/00; B21F 3/08; B21F 3/04; B65H 77/00

[52] U.S. Cl. ..... 72/371; 72/148; 29/605; 242/45; 242/75.2; 140/92.2

[58] Field of Search ..... 140/92.2, 71 C, 92.1; 242/45, 7.03, 25 R, 75, 75.2, 7.13; 29/605; 72/146, 148, 371

[56] References Cited

U.S. PATENT DOCUMENTS

| | | | |
|---|---|---|---|
| 452,003 | 5/1891 | Lipe | 29/605 |
| 1,027,140 | 5/1912 | McKean | 242/45 |
| 1,062,930 | 5/1913 | Ryden et al. | 242/45 |
| 1,277,029 | 8/1918 | Benjamin | 72/148 |
| 2,040,775 | 5/1936 | Lorig | 72/146 |
| 2,161,076 | 6/1939 | Morgan | 72/371 |
| 2,214,332 | 9/1940 | Kline | 242/45 |
| 2,655,717 | 10/1953 | Dunn | 72/146 |
| 2,739,763 | 3/1956 | Silfverlin et al. | 72/148 |
| 2,930,014 | 3/1960 | Van Der Hoek et al. | 140/92.2 |
| 4,048,713 | 9/1977 | Hvass | 72/342 |
| 4,773,245 | 9/1988 | Lawson et al. | 72/148 |

FOREIGN PATENT DOCUMENTS

| | | | |
|---|---|---|---|
| 332883 | 3/1972 | U.S.S.R. | 72/146 |

OTHER PUBLICATIONS

"The D-Shaped Main Field Coil for the ASDEX Fusion Experiment at the Max Planck Institute for Plasma Physics at Carching near Munich", Brown Boveri Review, vol. 64, Feb. 1977.

*Primary Examiner*—Robert L. Spruill
*Attorney, Agent, or Firm*—Leydig, Voit & Mayer

[57] ABSTRACT

A process for making a coil having no bobbin comprises the steps of connecting one end of an electrical conductor to a coil making jig, rotating the jig to wind the electrical conductor thereon while applying a tension to the conductor as the coil is being formed, and removing the coil from the jig, the tension on outer windings of the coil being greater than that on inner windings thereof. Accordingly, the outer winding provides a high pressure against the inner winding such that a high friction is produced between the adjacent windings, whereby the windings of the coil do not subsequently separate from each other.

14 Claims, 3 Drawing Sheets

PROCESS FOR MAKING A COIL

BACKGROUND OF THE INVENTION

This invention relates to a process for making a coil, and more particularly, to a process for making a coil having no bobbin, such as a large solenoid coil for a detector for use in the high energy physical experimentation or a coil for a nuclear fusion reactor.

FIG. 1 illustrates an example of a conventional process for making a toroidal field coil which is disclosed in an article entitled "The D-shaped Main Field Coil for the ASDEX Fusion Experiment at the Max Plank Institute for Plasma Physics at Garching near Munich" in Brown Boveri Review, Volume 64, of Feb. 2, 1977.

The conventional process for making a coil comprises the steps of connecting one end 6 of an electrical conductor 1 between two of the base segments 3*a* which together constitute a D-shaped jig 3, rotating the jig 3 in the direction of arrows 4 to wind the conductor 1 thereon while applying a constant tension T to the conductor 1 by means of a tension generating unit 2, so that the conductor 1 is wound on the base segments 3*a* of the jig 3, removing the thus formed coil from the jig 3 and applying an insulating varnish on the outer surface of the coil.

Generally, in order to cohere coil windings to each other, a varnish treated insulation is inserted between the coil windings or is wound around the conductor 1, heated to cure the insulation and the coil windings and the coil is finally finished.

According to the conventional process as above described, the coil winding is carried out while applying a constant tension to the conductor 1 by means of the tension generating unit 2. When the coil is removed from the coil making jig 3, the windings of the coil are slightly diametrically decreased as a whole, so that the residual stress by the tension remaining in the conductor 1 becomes almost null.

In general, since the tension generating unit 2 is not very precise, a tolerance of about ±20% in tension results in the windings of the conductor 1. Accordingly, a residual stress corresponding to this tolerance exists in the conductor 1, and this residual stress produces a force to slide the turns constituting the coil windings which are adjacent to each other in different directions. When the turns of the conductor 1 slide with respect to each other, the rigidity of the coil becomes so weak that the coil deforms easily due to stresses such as electromagnetic forces generated during the operation of the coil. In the worst case, the coil can be mechanically and electrically destroyed.

SUMMARY OF THE INVENTION

Accordingly, an object of this invention is to provide a process for making a coil free from the above discussed problems.

Another object of this invention is to provide a process for making a coil whose conductor turns do not slide with respect to each other.

According to this invention, a process for making a coil having no bobbin comprises the steps of connecting one end of an electrical conductor to a jig, rotating the jig to wind the electrical conductor thereon while applying a tension to the conductor as the coil is being formed, and removing the coil from the jig, the tension applied to the conductor increasing as the coil is being formed, so that the tension on outer windings of the coil is greater than that on inner windings thereof, whereby the windings of the coil do not subsequently separate from each other.

BRIEF DESCRIPTION OF THE DRAWINGS

This invention will become more readily apparent from the following detailed description of the preferred embodiment of this invention taken in conjunction with the accompanying drawings, in which.

DETAILED DESCRIPTION OF THE PREFERRED EMBODIMENT

Figure 3:
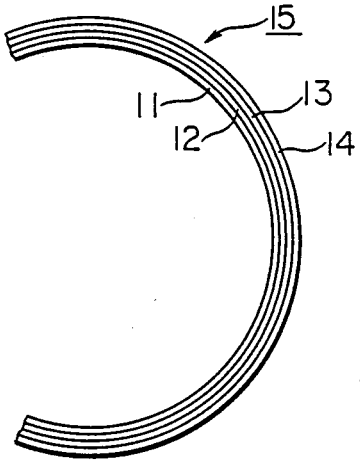
FIG. 3 is a side view of the coil of FIG. 2.
Figure 2:
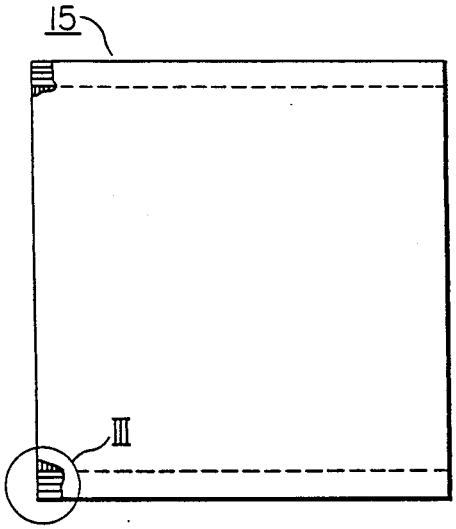
FIG. 2 is a front view of a solenoid coil.
Figure 4:
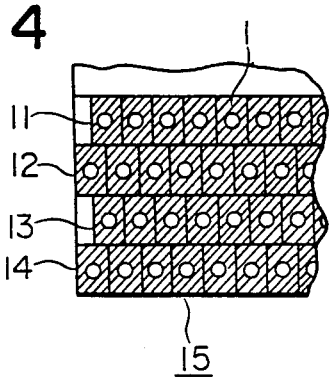
FIG. 4 is a cross sectional view of the coil of FIG. 1.

FIGS. 2 to 4 illustrate a large solenoid coil which is used as a part of a detector for use in a beam collision experiment for a high energy physics.

Referring to the figures, the coil 15 comprises a first winding 11, a second winding 12 which is wound on the first winding 11, a third winding 13 which is wound on the second winding 12 and a fourth winding 14 which is wound on the third winding 13.

Figure 5:
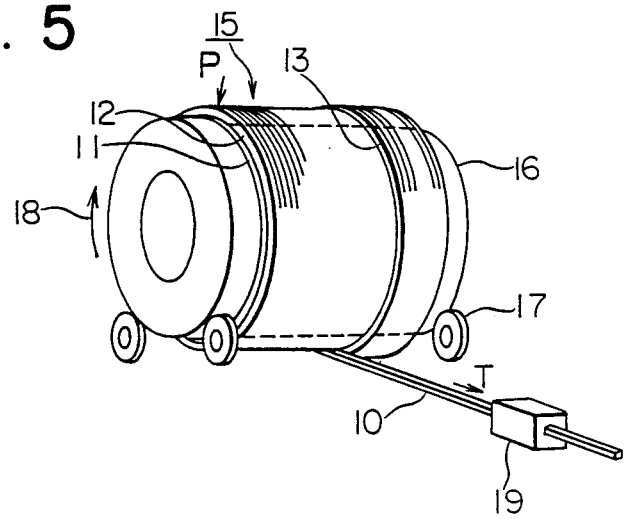
FIG. 5 is a schematic view illustrating a process for making a coil according to this invention.

FIG. 5 illustrates schematically a process for making the coil 15 having no bobbin by means of an example of a coil making apparatus. In the figure, the first and second windings 11 and 12 have been already formed on a coil making jig 16 and the third winding 13 is being formed on the second winding 12.

The process for making a coil according to this invention comprises the steps of connecting one end of an electrical conductor 10 to a cylinder shaped jig 16 which is rotatably supported by support wheels 17 which rotate the jig 16 in the direction of an arrow 18 to wind the conductor 10 thereon while a tension designated by T is applied to the conductor 10 i.e. the conductor 10 is pulled in the direction opposite to the rotational direction 18 by means of a tension generating unit 19. This unit 19 is disposed at a predetermined distance from the jig 16 to apply different tensions to the conductor 10 as the diameter of the windings of the coil 15 increases, i.e. the tension on outer windings of the coil is greater than that on inner windings thereof. The coil 15 which has been thus formed on the jig 16, is then removed from the jig 16.

Figure 6:
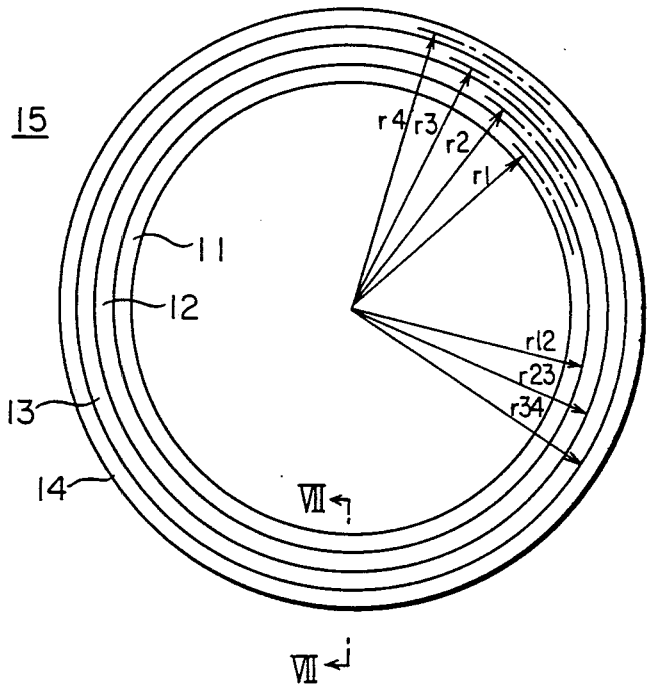
FIG. 6 is a schematic explicative view of the coil produced by the process according to this invention.
Figure 7:
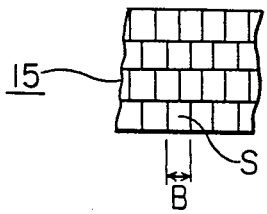
FIG. 7 is a schematic sectional view of the coil taken along line VII—VII in FIG. 6.

Referring now to FIGS. 6 and 7, the tensions of the first winding 11 to the fourth winding 14 of the coil 15 are referred as to $T_1$, $T_2$, $T_3$ and $T_4$ respectively. When the coil has not yet been removed from the cylinder jig 16, different strains $\epsilon_1$, $\epsilon_2$, $\epsilon_3$ and $\epsilon_4$ are generated on the windings 11, 12, 13 and 14 of the coil 15. When the cross sectional area of the conductor 10 is S as shown in FIG. 7 and Young's modulus is represented by E, the following equations are obtained.

$$\epsilon 1 = \frac{T_1}{SE}$$

$$\epsilon 2 = \frac{T_2}{SE}$$

$$\epsilon 3 = \frac{T_3}{SE}$$

$$\epsilon 4 = \frac{T_4}{SE}$$

When the coil 15 has been removed from the jig 16, the windings 11, 12, 13 and 14 thereof are uniformly diametrically contracted. If the radial contraction of the windings 11, 12, 13 and 14 is $\Delta r$, the strain of each winding can be obtained as follows:

$$\epsilon'_1 = \frac{T_1}{SE} - \frac{\Delta r}{r_1} \quad (1)$$

$$\epsilon'_2 = \frac{T_2}{SE} - \frac{\Delta r}{r_2} \quad (2)$$

$$\epsilon'_3 = \frac{T_2}{SE} - \frac{\Delta r}{r_3} \quad (3)$$

$$\epsilon'_4 = \frac{T_4}{SE} - \frac{\Delta r}{r_4} \quad (4)$$

Then, the balance between stresses at any coil section of the conductor 10 must be as follows;

$$SE\,(\epsilon'1+\epsilon'2+\epsilon'3+\epsilon'4)=0$$

whereby the following equation can be obtained:

$$\Delta r = \frac{T_1 + T_2 + T_3 + T_4}{SE\left(\frac{1}{r_1} + \frac{1}{r_2} + \frac{1}{r_3} + \frac{1}{r_4}\right)} \quad (5)$$

Now, if the pressure between the first winding 11 and the second winding 12 is $P_{12}$, that between the second winding 12 and the third winding 13 is $P_{23}$, that between the third winding 13 and the winding 14 is $P_{34}$, these pressures can be obtained as follows:

$$P_{12} = \frac{\epsilon'_1 SE}{r_{12}B} \quad (6)$$

$$P_{23} = \frac{r_{12}}{r_{23}} P_{12} + \frac{\epsilon'_2 SE}{r_{23}B} = \frac{SE}{r_{23}B}(\epsilon'_1 + \epsilon'_2) \quad (7)$$

$$P_{34} = \frac{r_{23}}{r_{34}} P_{23} + \frac{\epsilon'_3 SE}{r_{34}B} = \frac{SE}{r_{34}B}(\epsilon'_1 + \epsilon'_2 + \epsilon'_3) \quad (8)$$

$$= -\frac{SE}{r_{34}B}\epsilon'_4 \quad (9)$$

If the following values are substituted into the above equations (1) to (9), the pressures $P_{12}$, $P_{23}$ and $P_{34}$ can be obtained. The width of the conductor 10 is represented by B, and the conductor is wound as shown in FIG. 7.

$r_1$ = 1025 mm, $r_2$ = 1075 mm,
$r_3$ = 1125 mm, $r_4$ = 1175 mm
$B$ = 30 mm
$r_{12}$ = 1050 mm, $r_{23}$ = 1100 mm, $r_{34}$ = 1150 mm
$S$ = 1500 mm$^2$
$E$ = 12000 kg/mm$^2$
$T_1$ = 1500 kgf, $T_2$ = 2000 kgf,
$T_3$ = 2500 kgf, $T_4$ = 3000 kgf Accordingly, $\Delta r$ = 0.13714 mm
$\epsilon'_1$ = $-5.0465 \times 10^{-5}$
$\epsilon'_2$ = $-1.6465 \times 10^{-5}$
$\epsilon'_3$ = $1.6983 \times 10^{-5}$
$\epsilon'_4$ = $4.9948 \times 10^{-5}$
$P_{12}$ = $-0.0288$ kg/mm$^2$ = $-2.88$ kg/cm$^2$
$P_{23}$ = $-0.0365$ kg/mm$^2$ = $-3.65$ kg/cm$^2$
$P_{34}$ = $-0.0261$ kg/mm$^2$ = $-2.61$ kg/cm$^2$ If the values of the pressure $P_{12}$, $P_{23}$ and $P_{34}$ are negative, a compressive stress, i.e. a pressure exists between the windings 11, 12, 13 and 14.

As can be seen from the above description, it is possible to generate a considerable pressure between the windings, by varying the tension applied to the conductor 10. Specifically, the tension values $T_1$–$T_4$ shown above increase at a rate greater than proportional to the radii $r_1$–$r_4$. These tesion values, uesd for windings of these radii, result in the pressure values between windings given above.

Figure 1:
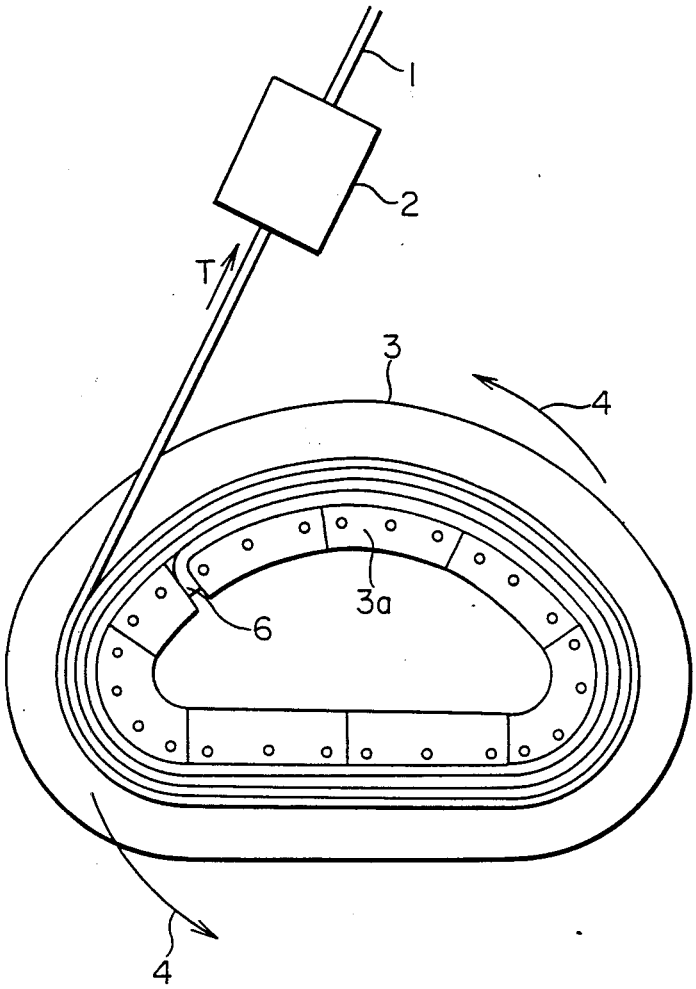
FIG. 1 PRIOR ART
FIG. 1 is a schematic view illustrating a conventional process for making a coil.

While a cylindrical solenoid coil is described in the above embodiment, the process according to this invention can be applied to any type of coils such as a non-cylindrical coil as shown in FIG. 1 or a pan-cake coil, thereby providing the same effect as that of the above embodiment.

In the above embodiment, a coil having four windings has been described, however, the process according to this invention can be applied to a coil having only two windings.

Further, the process according to this invention can be applied to not only a normal conducting coil but also to a superconducting coil.

As can be seen from the above, the coil winding is achieved while applying increasing tensions to the conductor as the diameter of the coil increases, i.e. the tension being greater on outer windings than on inner windings. Accordingly, a high pressure is generated between windings, so that a high friction is generated between windings, thereby preventing the windings of the coil from separating from each other.

What is claimed is:

1. A process for making a coil having no bobbin comprising the steps of:

connecting one end of an electrical conductor to a jig;

winding the electrical conductor upon the jig to produce a coil comprising a plurality of successive windings while applying a back tension to the conductor as the coil is being formed;

increasing the back tension applied to the conductor as the conductor is wound onto the jig so that the back tension applied to the outermost winding is greater than the back tension applied to the innermost winding, the back tension being increased by an amount sufficient to generate a compressive force between adjacent windings which is large enough to prevent the windings from sliding with respect to one another or separating from one another after the coil is removed from the jig; and removing the coil from the jig after forming the last winding of the coil.

2. A process for making a coil as set forth in claim 1 wherein the windings uniformly diametrically contract when the coil is removed from the jig.

3. A process for making a coil as set forth in claim 1 further comprising the step of applying insulating varnish to the outer surface of the coil.

4. A process for making a coil as set forth in claim 1 further comprising the steps of inserting varnish-treated insulation between each successive winding and heating to cure the insulation after the coil is removed from the jig.

5. A process for making a coil as set forth in claim 1 wherein varnish-treated insulation is wound around the conductor and further comprising the step of heating to cure the insulation after the coil is removed from the jig.

6. A process for making a coil as set forth in claim 1 wherein the plurality of windings is four windings.

7. A process for making a coil as set forth in claim 1 wherein the plurality of windings is two windings.

8. A process for making a coil as set forth in claim 1 wherein the coil is a superconducting coil.

9. A process for making a coil as set forth in claim 1 wherein the coil is a cylindrical solenoid coil.

10. A process for making a coil as set forth in claim 1 wherein the coil is a non-cylindrical coil.

11. A process for making a coil as set forth in claim 1 wherein the coil is a pancake coil.

12. A process for making a coil as set forth in claim 1 wherein in said step of increasing the back tension, the magnitude of back tension for each successive winding increases at a rate greater than proportional to the increase in diameter of the successive windings.

13. A process for making a coil as set forth in claim 1 wherein the desired magnitudes of back tension generate pressure between the windings, the pressure being of a magnitude sufficient to prevent the windings from separating from each other or sliding with respect to each other.

14. A process for making a coil as set forth in claim 1 wherein the back tension is the nominal back tension which is applied by a back tension generating apparatus having a prescribed percent tolerance, and the percent increase in the nominal back tension for each successive winding is large enough so that even if the actual back tension which is generated by the back tension generating apparatus varies from the nominal back tension by the percent tolerance, a compressive force will still be produced between adjacent windings of the coil.

* * * * *